United States Patent [19]

Mahoney, deceased et al.

[11] Patent Number: 4,676,503

[45] Date of Patent: Jun. 30, 1987

[54] BREAK-AWAY BASKETBALL GOAL APPARATUS

[76] Inventors: Elmo J. Mahoney, deceased, late of Dorrance; by Regina B. Mahoney, executrix; Kenneth J. Mahoney, both of Dorrance, all of Kans. 67634

[21] Appl. No.: 113,695

[22] Filed: Jan. 21, 1980

Related U.S. Application Data

[63] Continuation of Ser. No. 845,925, Oct. 27, 1977, abandoned.

[51] Int. Cl.[4] ..... A63B 63/08

[52] U.S. Cl. ..... 273/1.5 R

[58] Field of Search ..... 273/1.5 R, 1.5 A; 172/261-271

[56] References Cited

U.S. PATENT DOCUMENTS

| | | | |
|---|---|---|---|
| 75,669 | 3/1868 | Turk | 172/271 |
| 339,632 | 4/1886 | Eubanks | 172/269 |
| 1,167,122 | 1/1916 | Simmons | 172/269 |
| 2,935,144 | 5/1960 | Graham | 172/265 |
| 4,111,420 | 9/1978 | Tyner | 273/1.5 R |
| 4,365,802 | 12/1982 | Ehrat | 273/1.5 R |
| 4,534,556 | 8/1985 | Estlund et al. | 273/1.5 R |

FOREIGN PATENT DOCUMENTS

| | | | |
|---|---|---|---|
| R10927 | 6/1956 | Fed. Rep. of Germany | 172/269 |
| 1247726 | 8/1967 | Fed. Rep. of Germany | 172/269 |
| 1296916 | 5/1962 | France | 172/269 |
| 90883 | 11/1937 | Sweden | 172/269 |
| 1462352 | 1/1977 | United Kingdom | 172/269 |

OTHER PUBLICATIONS

Western Front, 9—1977, p. 35.

Little Giant/Glencoe Advertising Circular, 9—1972, 2 pages.

Slam Dunk Rim, Inc. Advertising Circular, 4—1978, 2 pages.

*Primary Examiner*—Paul E. Shapiro

*Attorney, Agent, or Firm*—Phillip A. Rein

[57] ABSTRACT

This invention is a break-away basketball goal apparatus having numerous embodiments but basically a feature whereby downward pressure on a basketball rim assembly causes the same to pivot or release to prevent damage to a backboard member. A few embodiments utilize biasing means to automatically restore a released rim assembly to its normal, horizontal usage condition. Other embodiments have an actuator latch assembly positioned in a concealed manner behind the backboard member. One other embodiment is a backboard break-away latch goal assembly wherein a portion of the backboard member with a rim assembly attached thereto breaks away on downward pressure applied thereto. It is the purpose of the break-away basketball goal apparatus to release a rim assembly when excessive pressure is applied thereto (normally by a basketball player during a dunking operation) to prevent breakage of the backboard member.

1 Claim, 19 Drawing Figures

BREAK-AWAY BASKETBALL GOAL APPARATUS

CROSS REFERENCE TO RELATED APPLICATIONS

This is a continuation of application Ser. No. 845,925 filed Oct. 27, 1977, now abandoned.

PRIOR ART

A patentability search was conducted on a break-away basketball goal and the following patents are noted: U.S. Pat. Nos. 3,907,304, 3,820,784, 3,788,642, 3,375,004, 3,017,183, 2,596,543, 2,473,908, 1,809,317.

Some of the patents such as Fox, Foitano, et al and Ebstein, et al teach foldable goals for (1) shipping purposes; and (2) movement to a vertical storage position. However, none of the prior art patents teach the function of a rim assembly attached to a backboard member such as to be released on excessive downward pressure applied thereto to prevent damage to the backboard member and also prevent any bending or damage to the rim member.

PREFERRED EMBODIMENT OF THE INVENTION

The break-away basketball goal apparatus of this invention includes numerous embodiments all having a main support housing connected to a backboard member, a releasable rim assembly connected to the main support housing, and an actuator latch assembly connected to the main support assembly and the releasably rim assembly. The actuator latch assembly holds the releasable rim assembly in the normal, horizontal usage position and permits downward movement of the rim member under excessive vertical pressure. In some cases, the actuator latch assembly operates to automatically move the rim member from a vertically inclined, released position back to the normal, horizontal usage position. In one embodiment, a rim member is held in an adjustable, clamped condition by a compression spring. In a coupled of other embodiments, a rim member is held in the usage position by spring members (such as tension or compression springs) and movable from a released, vertically, inclined position to the usage position automatically when a force against the rim member is released. In still another couple of embodiments, the actuator latch assembly is connected to the rim member but positioned behind the backboard member to conceal same plus remove any possible obstruction on the playing side of the backboard member. In another embodiment is a shear pin that breaks and releases the rim member on excessive pressure applied thereto. In one last embodiment, a backboard breakaway latch goal assembly is provided wherein a portion of the backboard pivots (with the rim member) away from the rest of the backboard member on excessive vertical pressure applied thereto.

OBJECTS OF THE INVENTION

On object of the break-away basketball goal apparatus of this invention is to provide a means of connecting a conventioal basketball rim member to a backboard in such a manner that is (1) held in the normal, horizontal usage position during conventional game playing; and (2) releasable on application of excessive pressure thereon to prevent damage to the backboard member.

One other object of the break-away basketball goal apparatus of this invention is to provide a releasable rim member that, after moved to a vertically inclined, released position, is automatically restored to the normal, horizontal usage position.

Still another object of the break-away basketball goal apparatus of this invention is to provide a releasable rim member that meets all the conditions and requirements of rigidity while being releasable under excessive vertical pressure and still satisfy the requirements of collegiate and professional basketball equipment rules.

One further object of the break-away basketball goal apparatus of this invention is to provide a releasable rim member that is automatically returned to the usage condition after being released plus being economical in price and easy to install for use on outdoor basketball goal structures.

Another object of the break-away basketball goal apparatus of this invention is to provide numerous embodiments for holding a rim member in the usage condition and only permit release thereof under excessive pressure normally caused by grasping thereof by a basketball player during a dunking operation and such embodiments shall be (1) economical to manufacture; (2) reliable in operation; (3) durable in construction; and (4) easy to install.

Various other objects, advantages, and features of the invention will become apparent to those skilled in the art from the following discussion, taken in conjunction with the accompanying drawings, in which:

DRAWING FIGURES OF THE INVENTION

Figure 1:
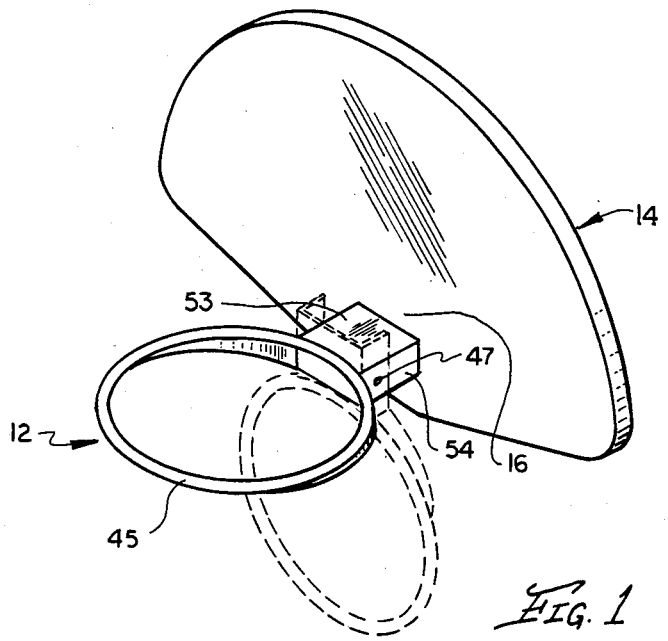
FIG. 1 is a perspective view of a spring latch goal assembly embodiment of the break-away basketball goal apparatus of this invention illustrated as mounted on a backboard member.

The following is a discussion and description of preferred specific embodiments of the new break-away basketball goal apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

The break-away basketball goal apparatus of this invention consists of numerous embodiments including combinations of a main support housing, a releasable rim assembly pivotally connected to the main support housing; and an actuator latch assembly connected to the main support housing and the rim assembly. Each of the actuator latch assemblies are operable to hold the rim assembly in a normal, horizontal usage condition but permits its movement to a vertically inclined position on application of excessive pressure thereto. Each embodiment is (1) either connectable to an existing backboard member; (2) connectable to a modified backboard member; or (3) constructed as a part of a backboard member that has a portion that breaks away under excessive pressure. The numerous embodiments of the break-away basketball goal apparatus are discussed in detail hereinafter.

Spring Latch Goal Assembly Embodiment

Figure 2:
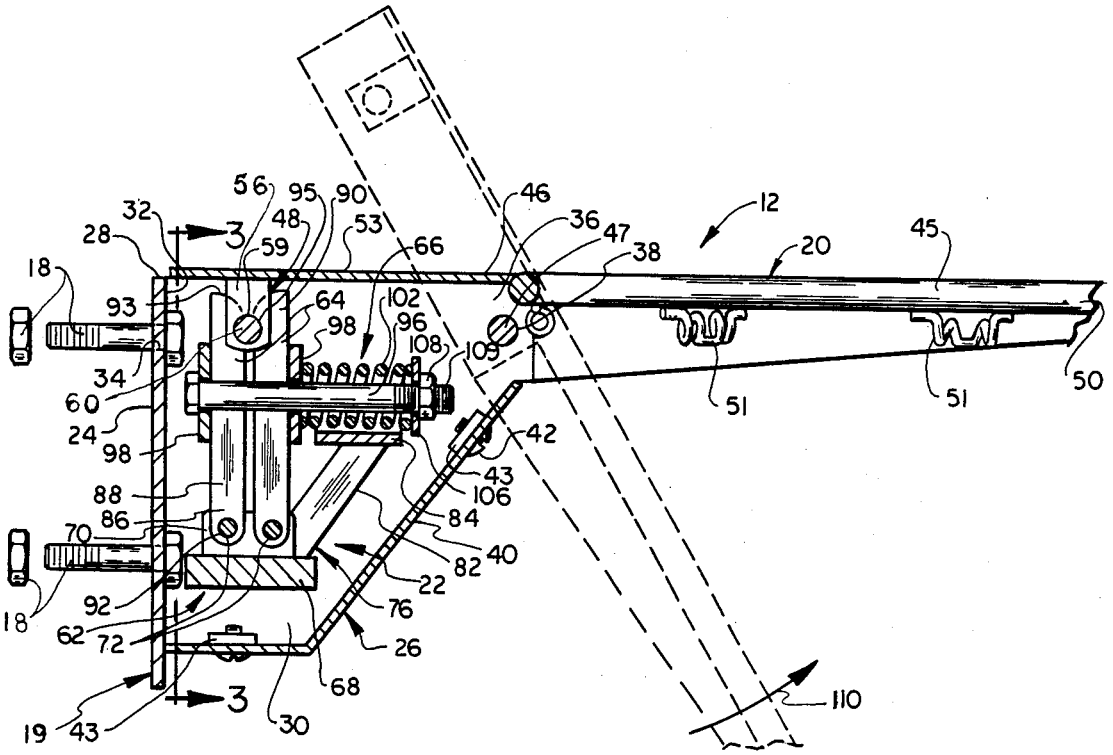
FIG. 2 is a side elevational view of the embodiment of FIG. 1 having portions broken away for clarity.
Figure 3:
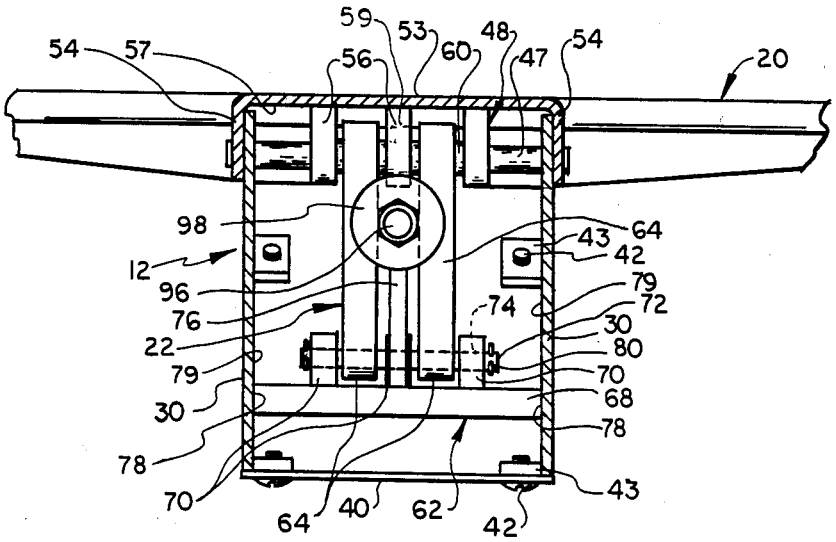
FIG. 3 is a fragmentary sectional view taken along line 3—3 in FIG. 2.

As collectively shown in FIGS. 1, 2, and 3, a spring latch goal assembly, indicated generally at 12, is shown as connected to a generally conventioal backboard member 14. the backboard member 14 is of a regulation shape and may be constructed of glass, metal, or wood and supported against a wall, a roof, or on a pole. A mid portion 16 of the backboard member 14 supports the spring latch goal assembly 12 in a conventional manner as by nut and bolt members 18.

The spring latch goal assembly 12 includes a main support housing 19 secured to the backboard member 14, a releasable rim assembly 20 pivotally connected to the main support housing 19, and an actuator latch assembly 22 secured to the main support housing 19 and operably connectable to the rim assembly 20.

The main support housing 19 includes a connector housing 24 with a cover assembly 26 connected thereto. The connector housing 24 includes a rectangular back plate 28 with forwardly projecting parallel side plates 30 secured to opposed, upright edges 32 of the back plate 28. The back plate 28 is formed with a plurality, namely four, holes 34 therein to receive the nut and bolt members 18 for securing to the backboard member 14. A forward portion 36 of each side plate 30 has aligned holes 38 to receive a portion of the rim assembly 20 as will be explained.

The cover assembly 26 includes an inclined cover plate 40 secured by bolt members 42 to nut members 43 which, in turn, are secured as by welding to respective side plates 30. The cover plate 40 functions to shield the actuator latch assembly 22.

The releasably rim assembly 20 includes a standard rim member 45; a top cover housing 46 secured to the rim member 45; a connector shaft member 47 connected to the top cover housing 46 and the main support housing 19; and a lock shaft assembly 48 secured to the top cover housing 46.

The standard rim member 45 is regulation size and includes the ring member 50 having a plurality of spaced net hangers 51 about its periphery to connect a basketball net thereto (not shown).

The top cover housing 46 is of U-shape in transverse cross section having a top wall 53 and integral sidewalls 54. The top cover housing 46 conceals the actuator latch assembly 22 when in the usage position of FIG. 1.

The connector shaft member 47, as shown in FIG. 3, extends through the sidewalls 54 and the side plates 30 and allows pivotal movement of the entire releasable rim assembly 20 thereabout as shown in dotted lines in FIG. 2.

As noted in FIG. 3, the lock shaft assembly 48 includes a plurality, namely three, spaced support lugs 56 secured to a bottom surface 57 of the topwall 53 and having aligned holes 59 therein to receive and support a latch or lock shaft 60. The lock shaft 60 cooperates with the actuator latch assembly 22 in a manner to be described.

The actuator latch assembly 22 includes a latch support base assembly 62; a pair of space cooperating actuator arms 64 pivotally connected to the latch support base assembly 62; and a biasing assembly 66 operably connected to the two sets of actuator arms 64. The latch support base assembly 62 includes a support base member 68; spaced lug members 70 secured to the support base member 68; a pair of spaced latch support shafts 72 mounted in aligned holes 74 in the lug members 70; and an alignment arm assembly 76 secured to the support base member 68. The support base member 68 is of a rectangular steel bar shape having opposite ends 78 secured, as by welding, to inner surfaces 79 of the respective side plates 30.

Each latch support shaft 72 is held in proper axial location in the lug members 70 by lock pins 80 inserted in holes at opposite ends thereof.

The alignment arm assembly 76 includes a support arm 82 secured to support base member 68 and the central lug member 70 and having a horizontal spring support member 84 secured to an upper end of the support arm 82.

The facing pairs of actuator arms 64 cooperate with each other similar to a clothes pin (see FIG. 2) with each having a connector portion 86 integral with a central portion 88 which, in turn, is integral with a top clamp portion 90. Each connector portion 86 is formed with a mounting hole 92 to receive a respective latch support shaft 72 therein for pivotal movement.

Each top clamp portion 90 is formed with a top curved edge 93 leading to a notched section 95. The cooperating actuator arms 64 have the notched sections 95 operable to receive a portion of the lock shaft 60 therein in a clamped condition (FIG. 2).

As shown in FIG. 2, the biasing assembly 66 includes a support bolt member 96; a pair of bearing washers 98 mounted on the bolt member 96; a biasing member or compression spring member 102 mounted about the bolt member 96 having one end against a bearing washer 98; a washer member 106 having one side mounted against the other end of the compression spring member 102; and a nut member 108 threadably mounted on an end portion 109 of the support bolt member 96 against the other side of the washer member 106.

It is noted that the bolt member 96 has been trained through a first bearing washer 98; the space between the pairs of actuator arms 64; a second bearing washer 98; a center of the compression spring member 102; the washer member 106; and connected to the nut member 108. The nut member 108 is readily moved on the bolt member 96 to regulate compression force of the spring member 102 through the bearing washers 98 against the actuator arms 64.

USE AND OPERATION

In the use and operation of the spring latch goal assembly 12 of this invention, the structure is readily connected to the backboard member 14 at a mid portion 16 by the nut and bolt members 18. This assembly would resemble a conventional basketball goal assembly as shown in FIG. 1.

As notes in FIG. 1, the rim assembly 20 is held in the horizontal, usage position by clamping of the lock shaft assembly 48 between the cooperating pairs of the actuator arms 64. Of course, the actuator arms 64 are biased to the clamped condition by the compression spring member 102 and such holding force is easily regulated by axial movement of the nut member 108 on the threaded end of the bolt member 96.

In basketball play and practice, it is permitted to dunk the ball through the rim member 45 but one is not to hit or pull downwardly on the subject rim member 45. However, because of human error, such does not always happen and the basketball players weight may be applied on the rim member 45 which causes breakage of the backboard member 14.

However, with the spring latch goal assembly 12 of this invention, a preset downward force against the rim member 45 cuases a separation of the actuator arms 64 and release of the rimmember 45 to move to the vertically inclined condition as shown in FIG. 2. This relieves the pressure against the backbaord member 14 and prevents breakage thereof with resultant savings in material and manpower needed to repair same.

The rim member 45, after moved to the inclined released condition, can be pivoted, in the direction as shown by an arrow 110 to the normal, usage position illustrated by the solid lines in FIG. 2.

Foldable Latch Goal Assembly Embodiment

Figure 4:
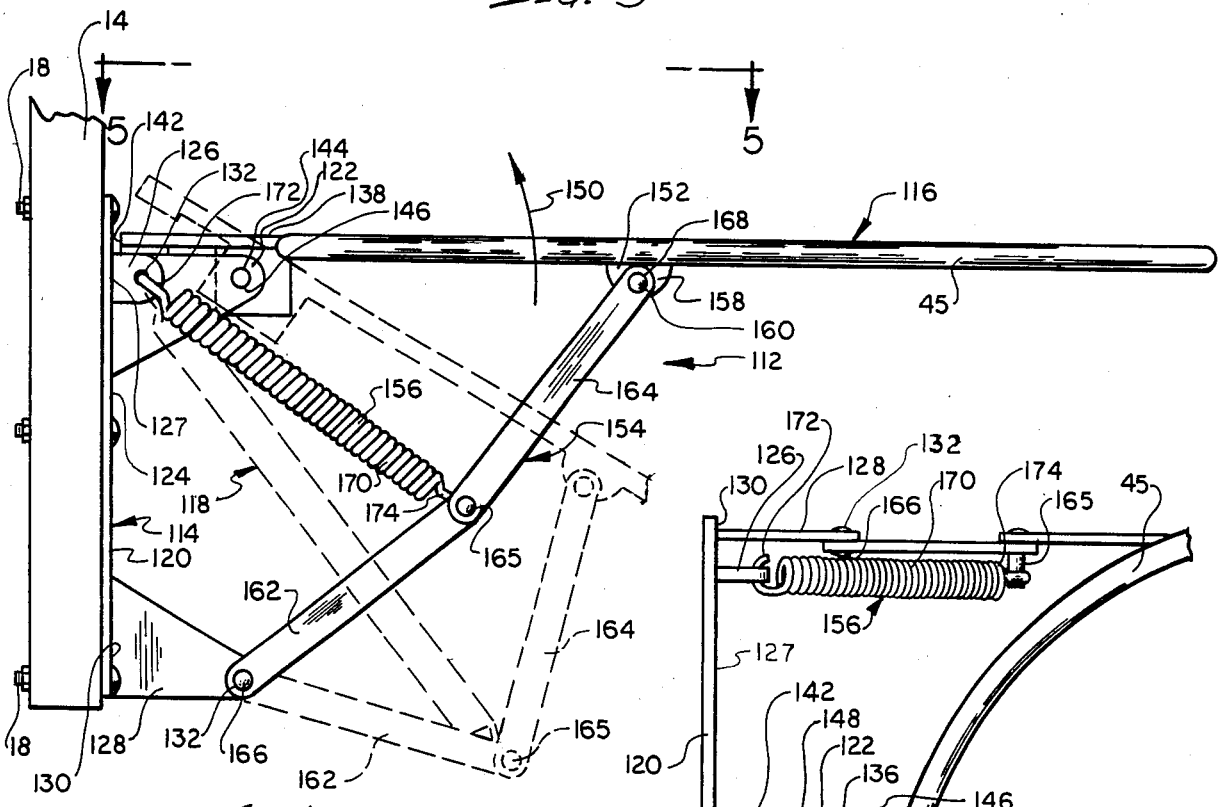
FIG. 4 is a side elevational view of a foldable latch goal assembly embodiment illustrated as connected to a portion of a backboard member and having movement toward a released position shown in dotted lines.
Figure 5:
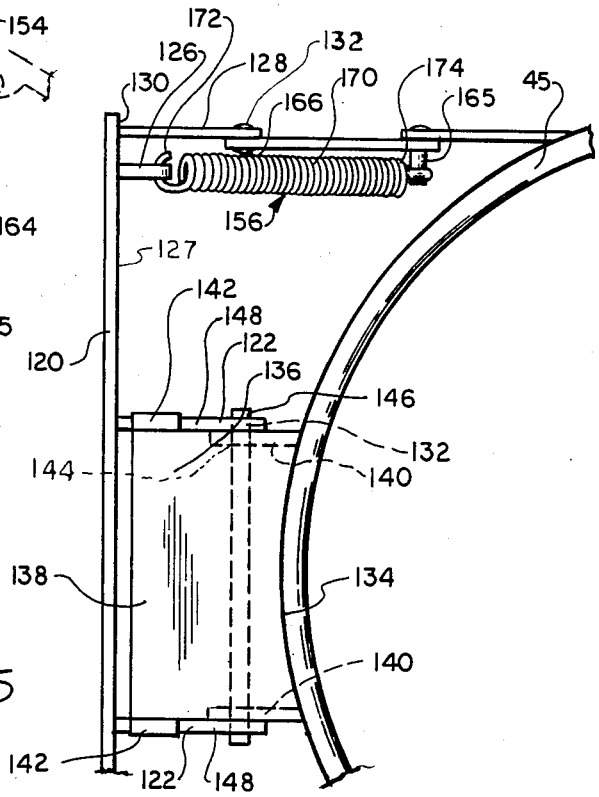
FIG. 5 is a fragmentary sectional view taken along line 5—5 in FIG. 4.

As collectively shown in FIGS. 4 and 5, a foldable latch goal assembly 112 is connectable by nut and bolt members 18 to the backboard member 14. The foldable latch goal assembly 112 includes a support housing 114; a releasable rim assembly 116 pivotally connected to the support housing 114; and an actuator latch assembly 118 connected to the support housing 114 and the releasable rim assembly 116.

The support housing 114 includes a vertical, rectangular shaped, base plate 120; parallel rim support lugs 122 secured to a central, upper portion 124 of the base plate 120; parallel spring support lugs 126 secured to the upper, outer edge portions 127 of the base plate 120; and linkage support lugs 128 secured to lower, outer edge portions 130 of the base plate 120. Each of the lugs 122, 126, and 128 has a hole 132 in the outer sections thereof for reasons to be explained.

The releasable rim assembly 116 includes the standard rim member 45 having an inner central portion 134 secured to a stop housing 136. The stop housing 136 has a top plate 138 with spaced, downwardly depending leg sections 140 and laterally extended, opposed stop members 142. The leg sections 140 are formed with aligned holes 144 to receive a support shaft 146 therethrough. The support shaft 146 also extends into the holes 132 in the rim support lugs 122 to permit pivotal movement of the releasable rim assembly 116 as shown in dotted lines in FIG. 4.

The stop members 142 contact respective upper surfaces 148 of the rim support lugs 122 to prevent pivotal movement beyond horizontal when moved in a counterclockwise direction as shown by the arrow 150.

The actuator latch assembly 118 includes a latch support base 152 connected to the rim member 45; actuator or linkage arm 154 connected to the support housing 114 and the latch support base 152; and a biasing assembly 156 connected to the linkage arm 154 and the support housing 114.

More particularly, the latch support base 152 includes a pair of linkage lugs 158 secured to opposed, respective sides of the rim member 45 and each having a connector hole 160 therein.

The linkage arms 154 includes spaced, pairs of identical first and second link members 162, 164 pivotally interconnected at one end thereof by a rivet member 165. An opposite end of the first link members 162 are pivotally connected by a rivet member 166 to the respective linkage support lugs 128. Similarly, an opposite end of the second link members 164 are pivotally connected by a rivet member 168 to the respective linkage lugs 158.

The biasing assembly 156 includes a spaced, pair of parallel tension spring members 170, each having one end section 172 connected to respective ones of spring support lugs 126 and other end sections 174 connected to respective ones of the rivet members 165.

USE AND OPERATION

In the use and operation of the foldable latch goal assembly 112, this presents an economical embodiment that is automatically spring biased to the normal, horizontal, usage position. On exerting downward pressure on the rim member 45, the first and second link members 162, 164 are movable toward the position as shown in dotted lines in FIG. 4. This is similar to linkage members shown in the prior arts as used on card tables except the longitudinal axis of the first and second link members 162, 164 are never aligned.

This movement causes a longitudinal expansion of the tension spring members 170 which inreases its force to move the rim member 45 back to the normal, horizontal usage position. This is achieved when the downward force against the rim member 45 is released and the stop members 142 contact the upper surfaces 148 of the rim support lugs 122.

Compression Latch Goal Assembly Embodiment

Figure 6:
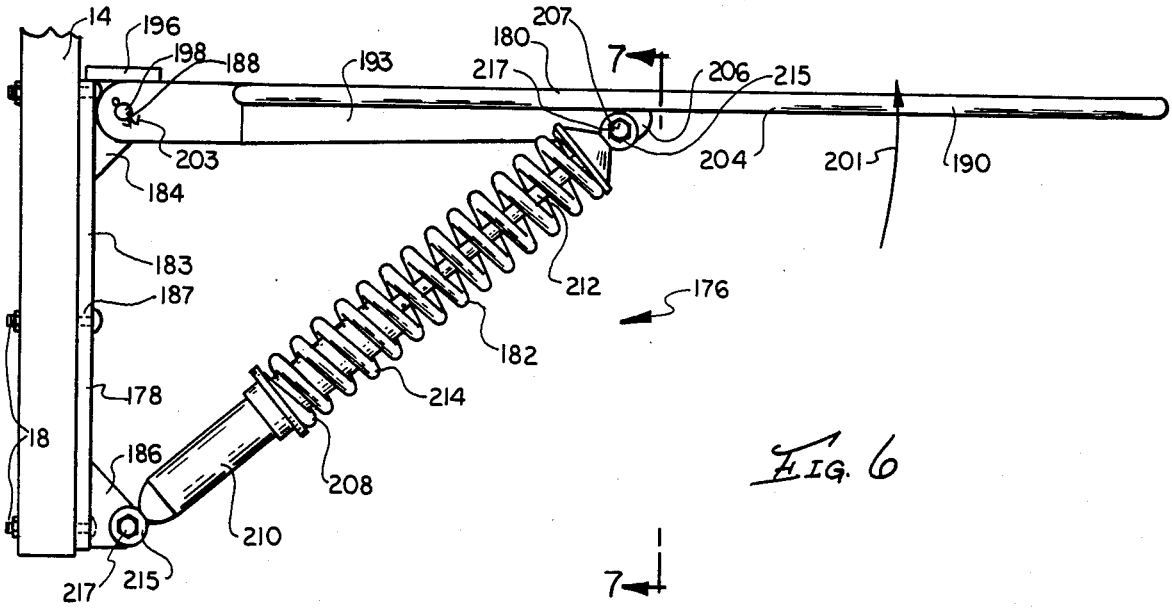
FIG. 6 is a side elevational view of a compression latch goal assembly embodiment illustrated as connected to a portion of a backboard member.
Figure 7:
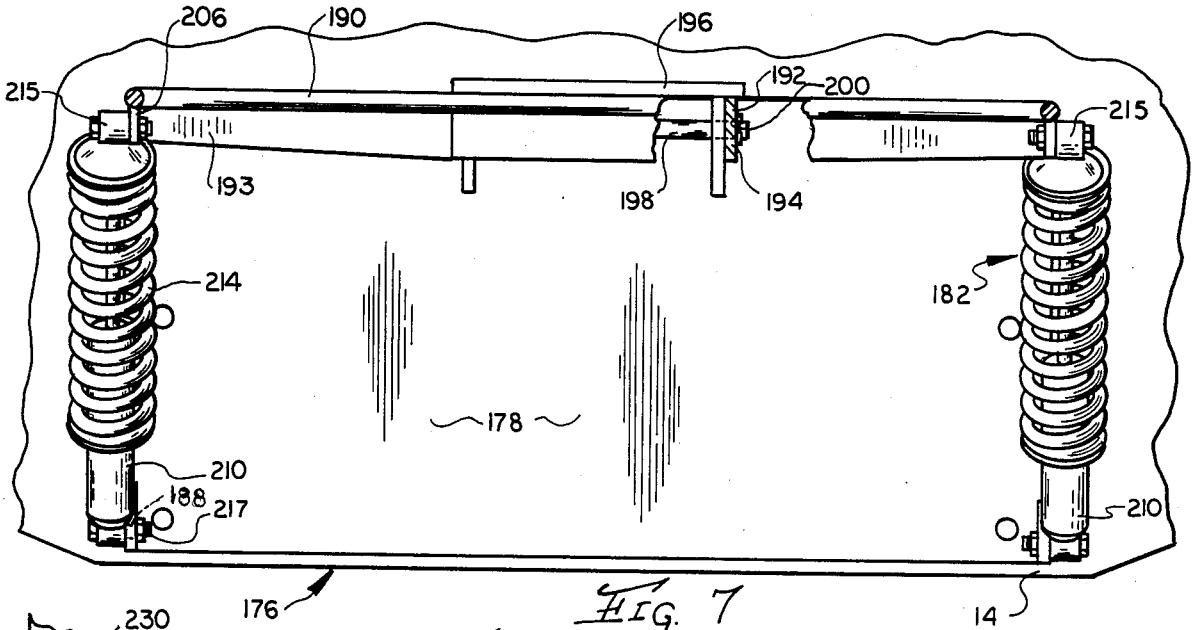
FIG. 7 is a fragmentary sectional view taken along line 7—7 in FIG. 6 and having portions broken away for clarity.

As collectively shown in FIGS. 6 and 7, a comrpession latch goal assembly, indicated generally at 176, is shown as secured to the backboard member 14 as by the nut and bolt members 18. More particularly, the compression latch goal assembly 176 inludes a main support housing 178; a releasable rim assembly 180 pivotally connected to the main support housing 178; and an actuator latch assembly 182 connected to the releasable rim assembly 180 and the main support housing 178.

The main support housing 178 includes a base plate 183 having rim support lugs 184 at upper, outer edges of the base plate 183 and spring support lugs 186 at lower, outer edges of the base plate 183. The base plate 183 has a plurality of holes 187 to receive the nut and bolt members 18 to anchor same to the backboard member 14. Each of the lugs 184 and 186 are provided with holes 188 for reasons to be explained.

The releasable rim assembly 180 includes the conventional rim member 190 having an inner edge secured to a connector housing 192 and a half portion is secured to a connector rim 193. the connector housing 192 includes a pair of parallel anchor plates 194; a top plate 196 secured to the anchor plates 194; and an anchor shaft 198. The anchor plates 194 are provided with aligned holes 200 to receive the anchor shaft 198 therethrough. The stop plate 196 abutts the rim support lugs 184 when in the usage position to limit rotation in the direction as indicated by an arrow 201. The anchor shaft 198 is also mounted in the holes 188 of the rim support lugs 184 and held against axial movement by cotter pins 203.

The connector rim 193 is secured to a bottom surface 204 of the rim member 190 and provides rigidity thereto. Opposed end portions 206 of the connector rim 193 are provided with holes 207 to be used in connecting to the actuator latch assembly 182.

The actuator latch assembly 182 includes a pair of compression spring assemblies 208 mounted on opposed sides of the rim member 190. Each spring assembly 208 resembles a shock absorber having a cylinder end 210; a piston and rod member 212 mounted in the cylinder end 210; and a compression spring member 214 mounted about the piston and rod member 212. Also, opposite ends of each spring assembly 208 is formed with a connector lug 215 usable with a nut and bolt member 217 for securing to respective spring support lugs 186 and the end portions 206 of the connector rim 193.

USE AND OPERATION

In the use and operation of the compression latch goal assembly 176, the base plate 183 is secured against the backboard member 14 with the nut and bolt members 18. The compression spring assemblies 208 act to hold the rim member 190 in the horizontal, usage position.

On application of downward pressure on an outer portion of the rimmember 190, it is obvious that each spring member 124 is compressed similar to the action of a shock absorber. The rim member 190 pivots about the anchor shaft 198 toward a downwardly inclined position.

On release of the rim member 190, it is obvious that the compressed spring members 214 moves the rim member 190 upwardly. The stop plate 196 contacts the top surface of the base plate 183 of the support housing 178 to position the rim member 190 automatically in the horizontally, usage position.

Central Pivot Latch Goal Assembly Embodiment

Figure 8:
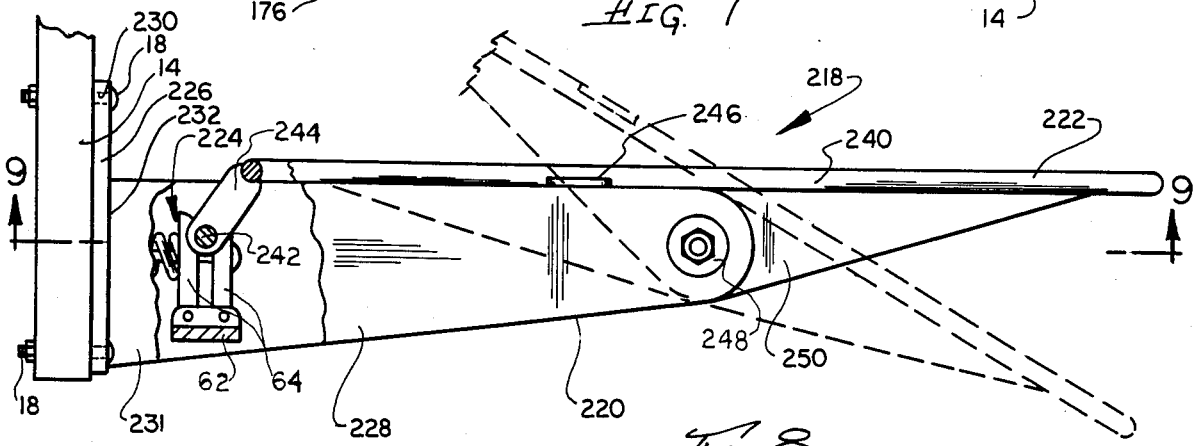
FIG. 8 is a side elevational view of a central pivot latch goal assembly embodiment illustrated as attached to a portion of a backboard member and having movement toward a released position shown in dotted lines.
Figure 9:
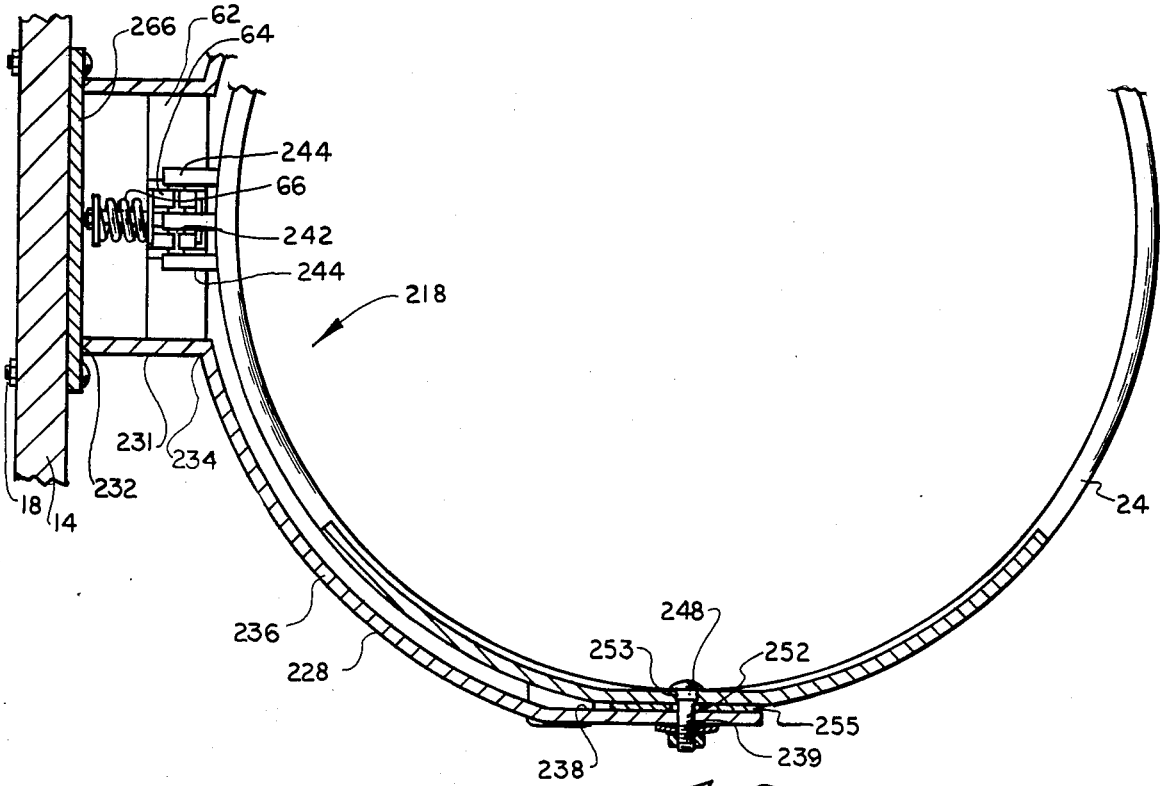
FIG. 9 is a fragmentary sectional view taken along line 9—9 in FIG. 8.

As collectively shown in FIGS. 8 and 9, a central pivot latch assembly, indicated generally at 218, is shown as secured to the backboard member 14 by the nut and bolt members 18. More particularly, the central pivot latch goal assembly 218 includes a main support housing 220; a releasable rim assembly 222 pivotally connected to the main support housing 220; and an actuator latch assembly 224 connected to the releasable rim assembly 222 and the main support housing 220.

The main support housing 220 includes a base plate 226 and a pair of rim support arms 228 connected to the base plate 226. The base plate 226 is of rectangular shape and has a plurality of holes 230 to receive the nut and bolt members 18 to anchor same to the backboard member 14.

Each rim support arm 228 includes a support plate 231 having an edge 232 secured to the base plate 226 and another edge 234 integral with a curved rim support member 236. The outer end of each rim support member 236 is formed with a flat surface 238 and a central hole 239 for reasons to be explained.

The releasable rim assembly 222 includes a conventional rim member 240 having a latch or connector shaft 242 secured by lug members 244 to the area adjacent the backboard member 14, a stop member 246 secured to the rim member 240, and a connector assembly 248 to pivotally connect the rimmember 240 to the rim support member 236.

The connector assembly 248 includes a main body 250 connected to a lower surface of the rim member (on each side); a nut, bolt, and washer member 252 inserted through the central hole 239 and a hole 253 in the main body 250, and a friction pad 255 mounted between the flat surface 238 and the main body 250.

The nut, bolt, and washer member 252 is adjustable to regulate the force needed to tilt the rim member 240 due to the areas of frictional contact.

The actuator latch assembly 224 is an option with this embodiment and provides an additional latching means for the releasable rim assembly 222. In fact, the actuator latch assembly 224 is substantially identical to that of FIGS. 1, 2, and 3 having the latch support base assembly 62; a pair of actuator arms 64 pivotally connected to the latch support base assembly 62; and a biasing assembly 66 operably connected to the actuator arms 64. The actuator arms 64 grasp onto the latch connector shaft 242 in the horizontal usage position. Further discussion of this latch mechanism is not deemed necessary as operates identical tot he actuator latch assembly 22 set forth in the first described embodiment.

USE AND OPERATION

In the use and operation of the central pivot latch goal assembly 218, the base plate 226 is connected to the backboard member 14 with the nut and bolt members 18 in a conventional manner.

In the horizontal usage position, it is held as shown in FIG. 9 by both (1) the friction connection with the friction pad 225; and (2) the actuator latch assembly 224 with either (1) or (2) sufficient but superior latching is achieved by the combinations of (1) and (2).

On application of downward pressure on an outer portion of the rim member 240, the actuator latch assembly 224 releases in a manner identical to that shown in FIG. 2. The rim member 240 moves to the positon shown in dotted lines in FIG. 8. The rim member 240 is reset by moving to a horizontal position and the actuator amrs 64 grasp the latch actuator shaft 242 and the stop member 246 contacts upper surfaces of respective ones of the main body 250 of the connector assembly 248.

Compression Tube Latch Goal Assembly Embodiment

Figure 10:
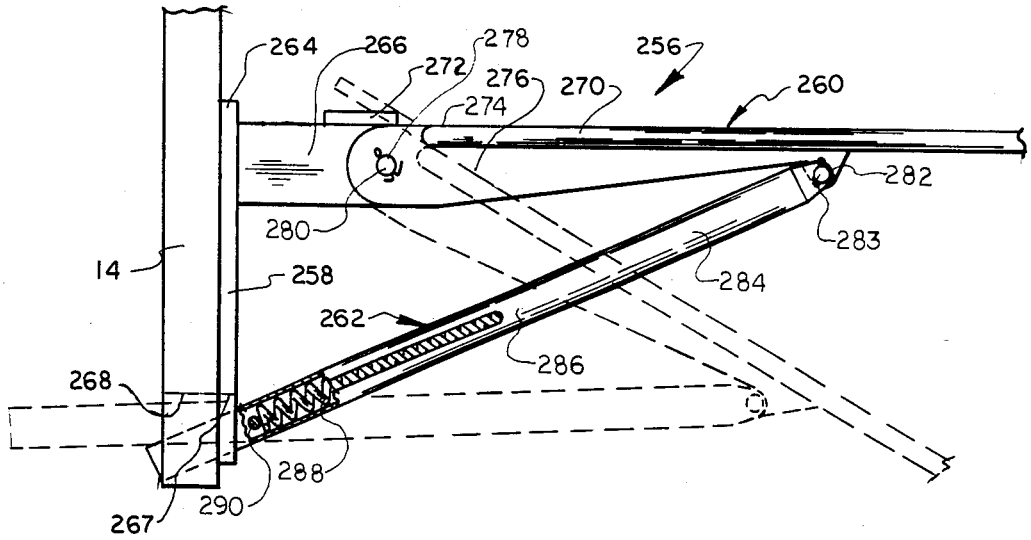
FIG. 10 is a fragmentary side elevational view of a compression tube latch goal assembly embodiment having movement toward a released position shown in dotted lines.

As shown in FIG. 10, a compression tube latch goal assembly, indicated generally at 256, includes a support housing 258 secured to the backboard member 14; a releasable rim assembly 260 connected to the support housing 258; and an actuator latch assembly 262 connected to the support housing 258 and the releasable rim assembly 260.

The support housing 258 includes a base plate 264 and a pair of spaced, parallel, support lugs 266 secured to the base plate 264. The base plate 264 is formed with spaced holes 267 to receive a portion of the actuator latch assembly 262 therethrough as will be explained. Also, the backboard member 14 is formed with spaced slots 268 adjacent the respective holes 267.

The releasable rim assembly 260 includes a conventional rim member 270 having a stop plate 272 secured to a top surface 274 and a connector rim 276 secured to opposite lower edges of the rim member 270. Each connector rim 276 has a hole 278 at one end to receive a connector shaft 280 to pivotally connect to the respective support lugs 266 and a hole 282 at the opposite end to receive a bolt member 283 for pivotal connected to the actuator latch assembly 262.

The actuator latch assembly 262 has a pair of biasing members 284 (one at each side of the rim member 270) similar to that shown in FIG. 7 although only one is clearly visible in FIG. 10. Each biasing member 284 includes a housing tube 286 with a compression spring member 288 therein.

A lower end of the housng tube 186 is pivotally connected to a support member 290 which is connected to a support member 290 which is connected to the base plate 264. An upper end of the housing tube 286 is pivotally connected to the bolt member 283 so that the housing tube 286 is movable toward the position shown in dotted lines in FIG. 10. A lower end of the compression spring member 288 contacts the stationary support member 290.

USE AND OPERATION

In the use and operation of the compression tube latch goal assembly 256, the backboard member 14 has to come with the slots 268 therein or specially cut out for mounting. The compression spring member 288 acts between the support member 290 and the upper end of the housing tube 286 to hold the rim member 270 in the horizontal, usage position as shown in FIG. 10. The stop plate 272 limits upward movement about the connector shaft 280.

On downward pressure on the rim member 270, the spring member 288 is compressed and the rim member 270 moves to the position as shown in dotted lines in FIG. 10. Obviously, on release of subject downward pressure, the compression spring members 288 automatically moves the rim member 270 back to the normal, horizontal, usage position.

Concealed Spring Latch Goal Assembly Embodiment

Figure 11:
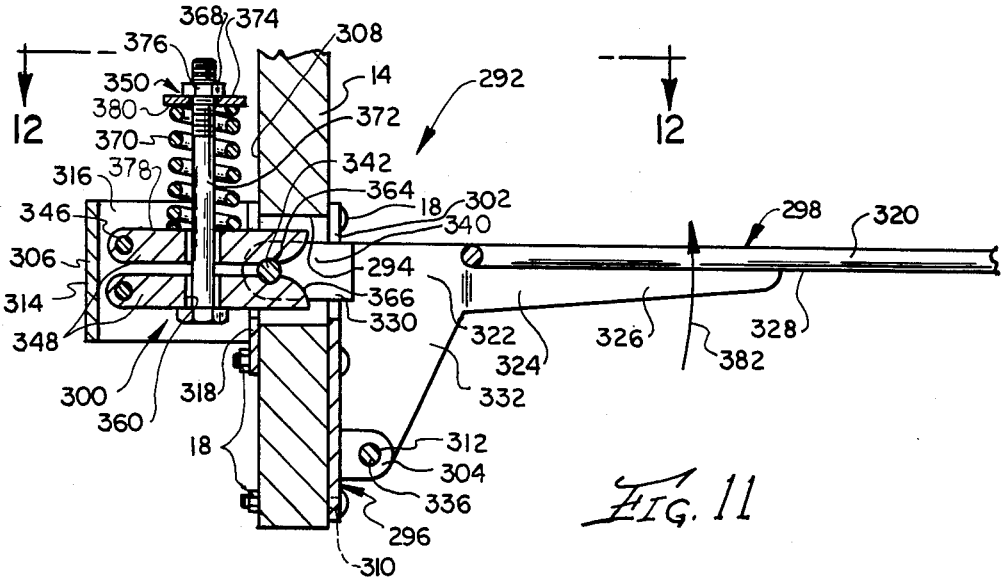
FIG. 11 is a fragmentary side view of a concealed spring latch goal assembly embodiment having portions shown in cross section for clarity.
Figure 12:
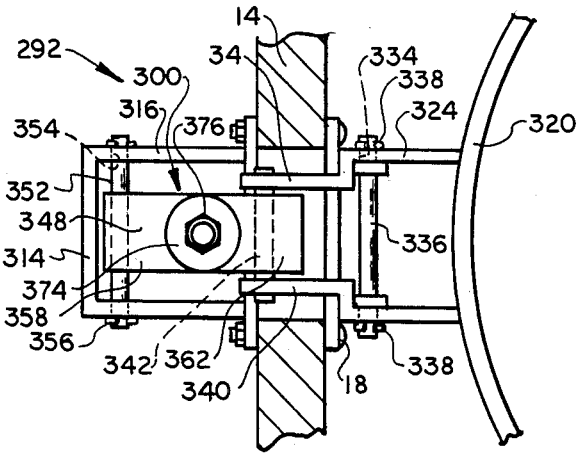
FIG. 12 is a fragmentary sectional view taken along line 12—12 in FIG. 11.

As shown in FIGS. 11 and 12, a concealed spring latch goal assembly, indicated generally at 292, is similar to the embodiment of FIG. 1 except the latching mechanism is mounted on the backside of a backboard member 14. The backboard member 14 is provided with a rectangular opening 294 for reasons to be explained.

The concealed spring latch goal assembly 292 includes a support housing 296; a releasable rim assembly 298 secured to the support housing 296; and an actuator latch assembly 300 connected to the support housing 296 and the releasable rim assembly 298. The support housing 296 includes a base plate 302 secured by the nut and bolt members 18 to the backboard member 14; a pair of spaced support lugs 304 connected to the base plate 302; and a latch cover housing 306 secured to a rear side 308 of the backboard member 14.

The base plate 302 is of rectangular plate shape having a plurality of spaced holes 310 to receive the nut and bolt members 18 therein. The support lugs 304 are formed with aligned holes 312 for reasons to be explained.

The latch cover housing 306 is of generally U-shape in transverse cross section having an outer wall 314 connected to parallel sidewalls 216 which, in turn, are secured to a front wall 318.

The releasable rim assembly 298 includes a conventional rim member 320 secured to a main rim support body 322. The rim support body 322 includes two, spaced, parallel support arms 324, each having forward portions 325 secured to opposed under surfaces 328 of the rim member 320 and a latch assembly 330. Each forward portion 326 is integral with a main body 332 having a hole 334 in a lower portion to receive a support shaft 336 therethrough. The rim member 320 is pivotal about the support shaft 336 which is locked against axial movement by cotter pins 338.

The latch assembly 330 includes a support lug 340 connected to respective ones of said support arms 324 and having a latch shaft 342 mounted therebetween.

The actuator latch assembly 300 resembles that shown in FIG. 2 and includes a latch support base 346 connected to the latch cover housing 306; actuator arms 348 pivotally connected to the latch support base 346; and a biasing assembly 350 mounted on the actuator arms 348. The latch support base 346 is a pair of spaced, parallel latch support shafts 352 having outer ends mounted in holes 354 in the sidewalls 316. Also, cotter pins 356 are mounted in holes, in each outer end of the latch support shafts 352 to prevent axial movement thereof.

The actuator arms 348 are two elements, each resembling a half portion of a clothes pin. More particularly, each actuator arm 348 includes an end portion 358 with a hole therein to receive respective ones of the latch support shafts 352; a mid-portion formed with a central hole 360; and an integral outer end portion 362 is formed with a half circle cut-out 364 and inclined outer end surfaces 366.

The biasing assembly 350 includes a nut and bolt assembly 368 having a compression spring member 370 mounted thereabout. The nut and bolt assembly 368 includes (1) a bolt member 372 mounted through the aligned central holes 360 in the actuator arms 348; (2) a washer member 374 mounted on the outer end of the bolt member 372; and (3) a nut member 376 threaded on the outer end of the bolt member 372. The compression spring member 370 is mounted about the bolt member 372 and held in compression by opposite ends in respective contact with (1) an upper surface 378 of the top actuator arm 348 and (2) a lower surface 380 of the washer member 374.

USE AND OPERATION

In the use and operation of the concealed spring latch goal assembly 292, the base plate 302 is secured to the backboard member 14 by the nut and bolt members 18 in a conventional manner. The actuator latch assembly 300 operates similar to that of FIGS. 1, 8 and 9.

Downward pressure on the outer portion of ther im member 320 causes the actuator arms 348 to further compress the compression spring member 370 and move the latch shaft 342 outwardly from the grasp of the outer end portions 362 of the actuator arms 348. Of course, this clamping action can be adjusted with axial movement of the nut member 376 on the bolt member 372.

An upward snapping movement of the rim member 320 is a counterclockwise direction as shown by the arrow 382 in FIG. 11 will cause a re-setting thereof to place the rim member 320 in the horizontal, usage position thus being ready for another cycle.

Concealed Compression Latch Goal Assembly Embodiment

Figure 13:
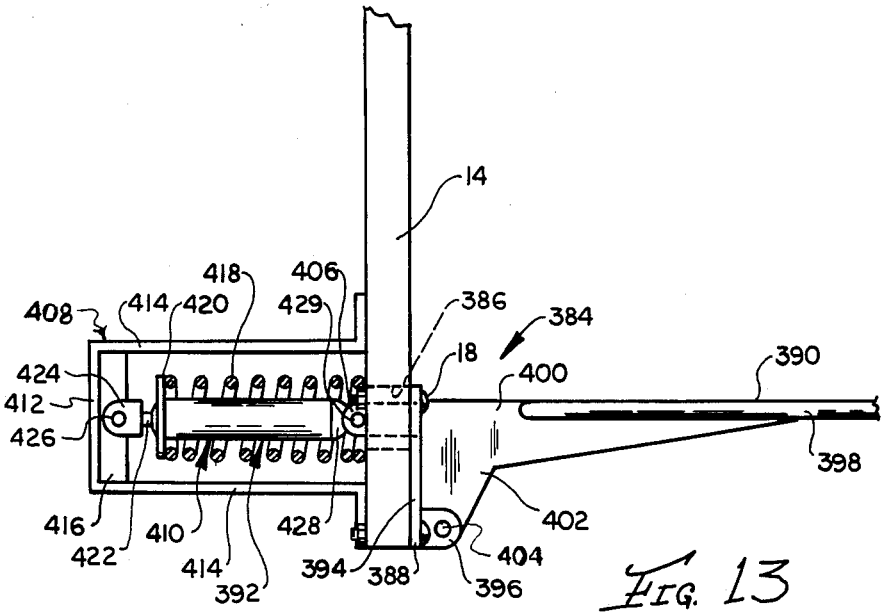
FIG. 13 is a side elevational view of a concealed compression latch goal assembly embodiment of this invention.

As shown in FIG. 13, a concealed compression latch goal assembly, indicated generally at 384, is similar in operation to the shock absorber type shown in FIGS. 6 and 7. However, the backboard member 14 is provided with a hole 386 therein and the actuator structure is mounted behind the backboard member 14. More particularly, the concealed compression latch goal assembly 384 includes a support housing 388 secured to the backboard member 14; a releasable rim assembly 390 connected to the support housing 338; and an actuator latch assembly 392 connected to the backboard member 14 and the releasable rim assembly 390.

The support housing 388 includes a base plate 394 secured as by nut and bolt members 18 to the backboard member 14 and having support lugs 396 extended from the base plate 394.

The releasable rim assembly 390 includes a conventional rim member 398 connected to a support frame 400 which, in turn, is pivotally connected at a lower portion 402 by a support pin 404 to the support lugs 396 on opposite sides. Also, the support frame 400 has a central connector lug 406 extended rearwardly through the hole 396 in the backboard member 14 for connection to the actuator latch assembly 392 in a manner to be described.

The actuator latch assembly 392 includes a latch support frame 408 secured to the backboard member 14 and connected to a compression spring assembly 410. The latch support frame 408 is of generally U-shaped having a backwall 412 integral with parallel sidewalls 414. A connector plate 416 is welded between the backwall 412 and adjacent portions of the sidewalls 414.

The compression spring assembly 410 includes a spring member 418 mounted about a spring housing 420 to bias same to the left as viewed in FIG. 13. A rear portion 424 of the spring housing 420 is pivotally connected by a pin member 426 to the connector plate 426. A forward portion 428 of the spring housing 420 is pivotally connected by a connector pin 429 to the connector lug 406 of the support frame 400.

USE AND OPERATION

In the use and operation of the concealed compression latch goal assembly 384, the base plate 394 is secured to the backboard member 14 in a conventional manner. The actuator latch assembly 392 operates similar to that shown in FIG. 6.

Downward pressure on the outer portion of the rim member 398 causes compression of the spring member 418. On release of the pressure, the spring member 418 moves the rim member 398 back to the normal, horizontal, usage position as shown in FIG. 13.

Backboard Break-away Latch Goal Assembly Embodiment

Figure 14:
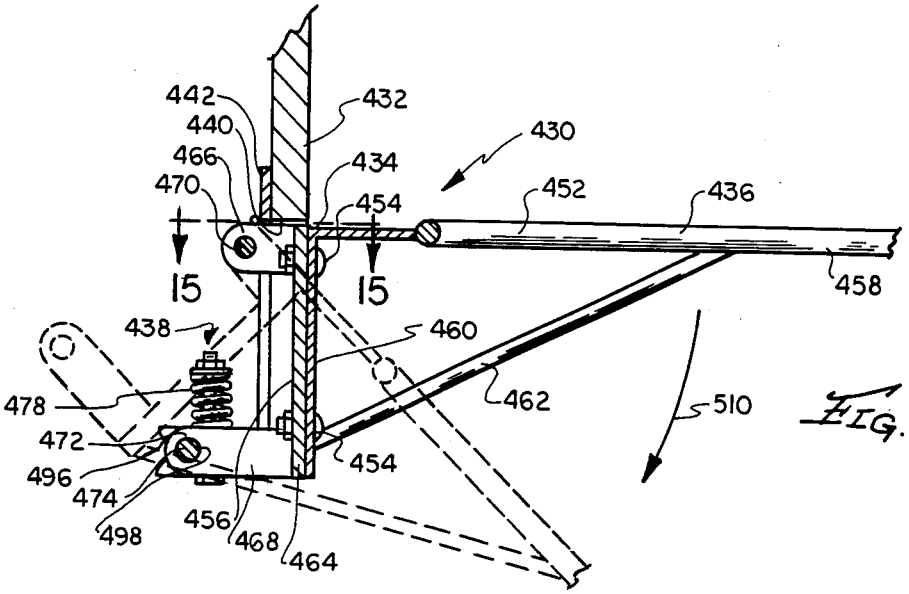
FIG. 14 is a fragmentary sectional view of a backboard break-away latch goal assembly taken along line A—A in FIG. 15 having movement toward a released position shown in dotted lines.
Figure 15:
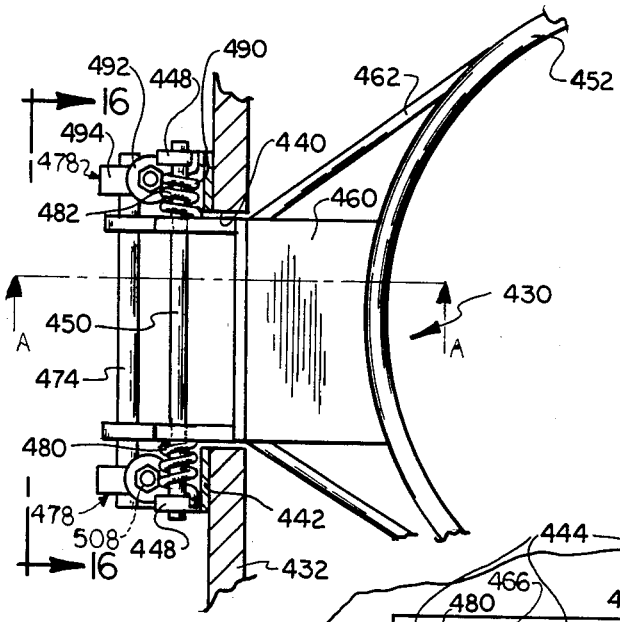
FIG. 15 is a fragmentary sectional view taken along line 15—15 in FIG. 14.
Figure 16:
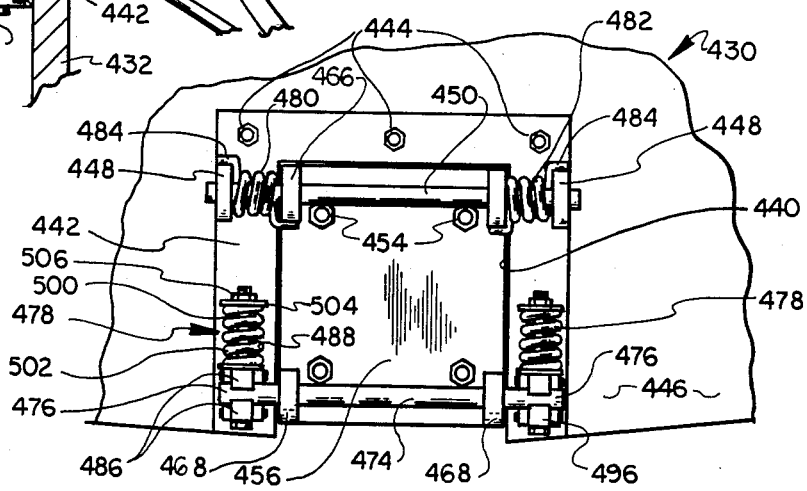
FIG. 16 is a fragmentary sectional view taken along line 16—16 in FIG. 15.

As shown in FIGS. 14, 15, and 16, a backboard break-away latch goal assembly, indicated generally at 430, has a specially designed support backboard member 432 and utilizes a latch mechanism similar to that shown in FIG. 2. More particularly, the backboard break-away latch goal assembly 430 includes the support backboard member 432; a support housing 434 connected to the support backboard member 432; a releasable rim assembly 436 connected to the support housing 434; and an actuator latch assembly 438 secured to the support backboard member 432 and the releasable rim assembly 436.

The support backboard member 432 is unique in having a central, rectangular opening 440 positioned where a conventional rim member is mounted for reasons to become obvious.

The support housing 434 includes a U-shaped base plate 443 secured as by bolt members 444 to a rear surface 446 of the backboard member 432, and opposed, rearwardly extended support lugs 448 operable to hold a support shaft 450 therein. The base plate 442 is secured about the periphery of the opening 440 in the backboard member 432.

The releasable rim assembly 436 includes a conventional rim member 452 secured as by nut and bolt members 454 to a connector plate assembly 456. The rim member 452 includes a circular ring 458 secured to a hanger plate 460 with the parts strengthened by inclined support struts 462.

The connector plate assembly 456 fills the rectangular opening 440 in the backboard member 432 and includes a plate member 464 having upper, spaced connector lugs 466 and lower, spaced latch connector lugs 468. The connector lugs 466 have aligned holes 470 therein to rotatably receive the support shaft 450 therein.

The latch connector lugs 468 extend substantially rearwardly from the plate member 464 having aligned holes 472 with a latch shaft 474 mounted therein. Outer end portions 476 of the latch shaft 474 extend laterally of the plate member 464 for grasping by the actuator latch assembly 438.

The actuator latch assembly 438 includes a pair of spaced, identical clamp latch assemblies 478 and plate closure members 480. The plate closure members 480 are each a coil spring member 482 mounted about respective, outer ends of the support shaft 450. Each coil spring member 482 has outer end portions 484 which biases the interconnected hanger plate 460 and plate member 464 toward the usage position as shown in FIG. 14.

Each clamp latch assembly 478 includes a pair of actuator arms 486 pivotally connected to the plate member 464 and a biasing assembly 488 connected to the actuator arms 486. The actuator arms 486 cooperate similar to a clothes pin with each having a connector portion 490 integral with a central portion 492 which, in turn, is integral with a clamp portion 494. Each clamp portion 494 is formed with a top curved edge 496 leading to a notched section 498. The cooperating pairs of notched sections 498 aare operable to clamp about the end portions 476 of the latch shaft 474.

Each biasing assembly 488 includes a support bolt member 500; a biasing member or compression spring member 502 mounted about each bolt member 500; a washer member 504 mounted against the upper ends of the compression spring member 502; and a nut member 506 threadably mounted on the upper end of the bolt member 500. The pairs of cooperating actuator arms 486 are formed with a central hole 508 to receive the bolt member 500 therethrough. The compression springmember 502 acts between the top one of the actuator arms 486 and the washer member 504 to bias the actuator arms 486 into a clamped condition.

USE AND OPERATION

In the use and operation of the backboard break-away latch goal assembly 430 of this invention, the backboard member 432 is specially constructed and the releasable rim assembly 436 is positioned as shown in FIG. 14 in the normal, horizontal usage position.

On downward pressure on an outer portion of the rim member 452, the actuator latch assembly 432 releases the latch shaft 474 from the clamped condition with the actuator arms 486. The rim member 452 moves as shown by the arrow 510 and dotted lines in FIG. 14. This causes winding of the coil spring members 482 mounted about the support shaft 450.

On release of the rim member 452, the coil spring members 482 act to move the same to the normal, usage position. The clamping action of the actuator arms 486 can be regulated by adjustment of the nut members 506 on the respective bolt members 500.

Shear-Pin Latch Goal Assembly Embodiment

Figure 17:
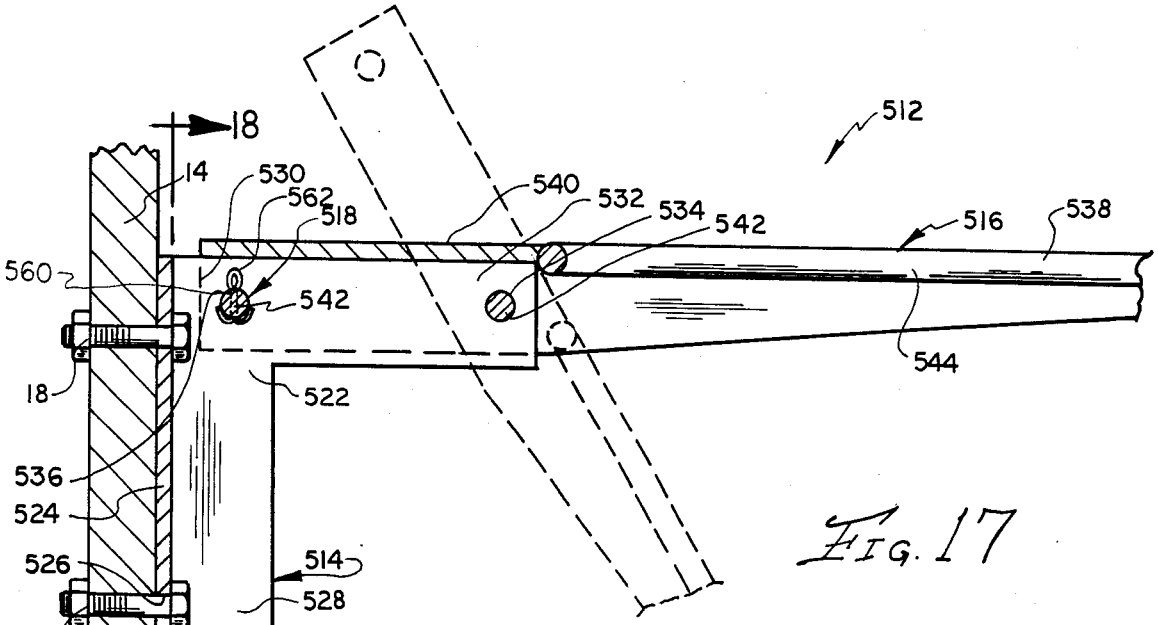
FIG. 17 is a fragmentary sectional view of a shear pin latch goal assembly having portions broken away for clarity.
Figure 18:
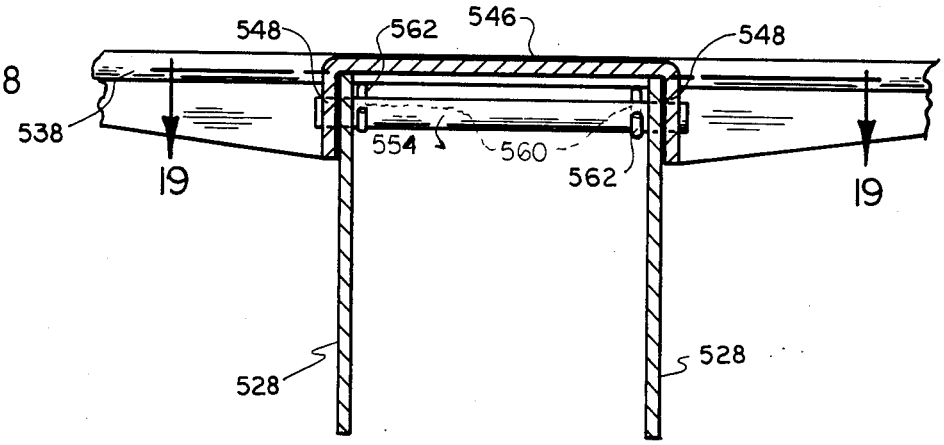
FIG. 18 is a sectional view taken along line 18—18 in FIG. 17.
Figure 19:
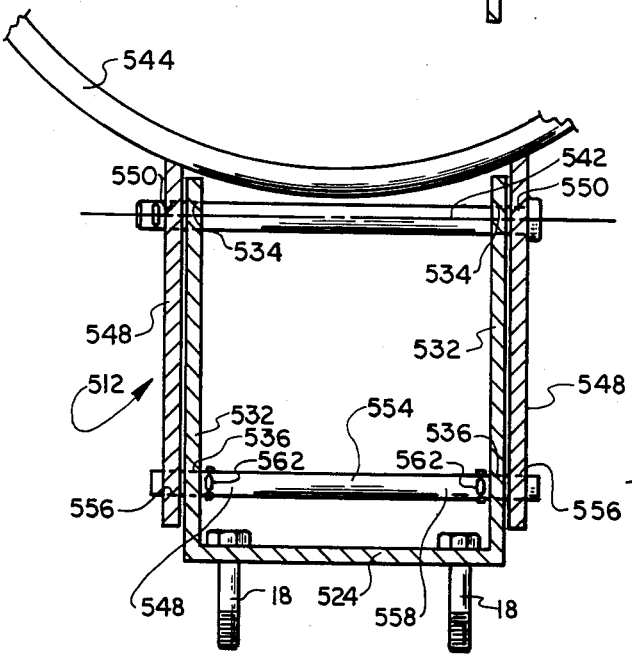
FIG. 19 is a sectional view taken along line 19—19 in FIG. 18.

As shown in FIGS. 17, 18, and 19, a shear pin latch goal assembly, indicated generally at 512, is shown as connected to a conventional backboard member 14 by the nut and bolt members 18.

The shear pin latch goal assembly 512 includes a main support housing 514 secured to the backboard member 14; a releasable rim assembly 516 pivotallyconnected to the main support housing 514; and an actuator latch assembly 518 secured to the main support housing 514 and operably connectable to the rim assembly 516.

The main support housing 514 includes a connector housing 520 with a support assembly 522 connected thereto. The connector housing 520 includes a rectangular base plate 524 having a plurality, namely four, holes 526 therein to receive the nut and bolt members 18 for securing to the backboard member 14.

The support assembly 522 includes parallel side plates 528 secured to the base plate 524 and upper areas 530 integral with parallel support plates 532. the support plates 532 are formed with aligned first and second openings 534, 536 for reasons to be explained.

The releasable rim assembly 516 includes a standard rim member 538; a top cover housing 540 secured to the rim member 538; and a connector shaft member 542 connected to the top cover housing 540 and the support plates 532.

The standard rim member 538 is of regulation size and includes a ring member 544 having a plurality of spaced net hangers about its periphery to connect a basketball net thereto (not shown).

The top cover housing 540 is of U-shape in transverse cross section having at op wall 546 and integral sidewalls 548. The sidewalls 548 have aligned holes 550 therein adjacent the ring member 544 to receive the connector shaft member 542 therein.

The connector shaft member 542 extends through the sidewalls 548 and the support plates 532 in the holes 550 and the first openings 534 and held against axial movement by a cotter pin 552. This allows pivotal movement of the entire releasable rim assembly 516 thereabout as shown in dotted lines in FIG. 17.

The actuator latch assembly 518 includes a shear pin member 554 mounted in the second openings 536 and in aligned pin holes 556 in the sidewalls 548. Opposite end portions 558 of the shear pin 554 are formed with holes 560 therein to receive respective cotter pins 563. This prevents unintentional axial movement of the shear pin 554.

USE AND OPERATION

In the use and operation of the shear pin latch goal assembly 512 of this invention, the structure is easily connected to the backboard member 14 by the nut and bolt members 18. The rim member 538 is held in the horizontal usage position by the use of the shear pin 554 in the second openings 536 and the holes 556.

On downward pressure against the rim member 538, a force is exerted on the shear pin 554. The shear pin 554 is designed to break or shear at a pre-determined pressure exerted thereagainst before any damage occurs to the rim member 538 or the backboard member 14. The released position is shown in dotted lines in FIG. 17.

The broken shear pin 554 is easily replaced with a minimum amount of skill and time required. The force required to shear the pin 554 can be regulated but a force between 200–300 PSI is desired. A shear force of 250 PSI requires is most desirable.

SUMMARY

The various embodiments of the break-away basketball goal apparatus of this invention are easy to install, sturdy in construction, and reliable in operation. The various embodiments are intended to present complex models for use in professional sports to simple playground structures.

While the invention has been described in conjunction with preferred specific embodiments thereof, it will be understood that this description is intended to illustrate and not to limit the scope of the invention, which is defined by the following claims:

I claim:

1. The break-away basketball goal apparatus connected to a conventional basketball backboard member, comprising:

(a) a support housing secured to said backboard member having a connector housing with a cover member releasably connected thereto;

(b) said connector housing includes a vertically extended back plate having rearwardly extended connector members for securing to said backboard member; spaced apart forwardly projecting parallel side plates secured to said back plate, said cover spanning said side plates;

(c) a releasable rim assembly pivotally connected to a forwardmost portion of said side plates of said support housing;

(d) said releasable rim assembly includes a rim member secured to a rearwardly extended top cover housing having a horizontal connector shaft member, outer ends of said connector shaft extended through downwardly extended sidewalls of said top cover housing and pivotally movable about pivotal connection to said side plates at an upper forward location thereon;

(e) said top cover housing of inverted U-shape in transverse cross section includes a top wall integral with said sidewalls and having a lock shaft assembly connected to the underside of said top wall, and said lock shaft assembly releasably engageable with an actuator latch assembly;

(f) said lock shaft assembly includes spaced support lugs having a horizontal lock shaft mounted therein; said lock shaft positioned adjacent said back plate and its longitudinal axis is perpendicular to said side plates;

(g) said actuator latch assembly connected to said support housing between said side plates and releasably connected to said lock shaft of said lock shaft assembly;

(h) said actuator latch assembly includes a horizontally extended support base member secured between said side walls and positioned adjacent an outer surface of said back plate; two pair of actuator arms having lower ends therof pivotally connected to said support base member, and a biasing assembly connected to said actuator arms to bias same into a clamped condition about said lock shaft member;

(i) said actuator arms extended vertically from said support base member, each having a top clamp portion with notched sections to receive a portion of said lock shaft therein in a clamped condition under force of said biasing assembly;

(j) said biasing assembly includes a horizontally extended bolt member having one end bearing against one of each pari of arms and extending between said pairs of actuator arms below said top clamp portions and above said support base member; a compression spring mounted on the other end of said bolt member forwardly of said actuator arms and bearing against the other one of each pair of arms; and a nut member threadably mounted and a washer member mounted on an outermost end of said bolt member with said compression spring between said actuator arms and said washer member to apply adjustable clamping force between said top clamp portions on said lock shaft member;

(k) said releasable rim assembly movable from a horizontal, usage position held by said actuator arms about said lock shaft member by the biasing force of said compression spring to a released, inclined position on application of a predetermined, adjustable pressure against said rim member to completely disengage said lock shaft member from said top clamp portions of said actuator arms and to prevent damage to said backboard member and said releasable rim assembly; and (l) said rim member selectively movable when desired to the horizontal usage position to have said lock shaft member of said releasable rim assembly firmly engaged by said top clamp portion of said actuator arms whereby basketball play can be resumed.

* * * * *